United States Patent [19]

Bjäreklint

[11] 4,274,939

[45] Jun. 23, 1981

[54] ELECTRODE PACKAGE AND USE THEREOF

[75] Inventor: Ake B. Bjäreklint, Vallentuna, Sweden

[73] Assignee: Svenska Utvecklingsaktiebolaget (SU) Swedish National Development Co., Stockholm, Sweden

[21] Appl. No.: 139,119

[22] Filed: Apr. 10, 1980

[30] Foreign Application Priority Data

Apr. 20, 1979 [SE] Sweden ..... 7903503

[51] Int. Cl.[3] ..... C25B 9/02; C25B 9/04; C25B 15/08; H01M 2/14

[52] U.S. Cl. ..... 204/257; 204/263; 204/269; 204/279; 204/288; 429/39

[58] Field of Search ..... 204/252–258, 204/263–266, 267–270, 286, 284, 288–289, 279; 429/34–39

[56] References Cited

U.S. PATENT DOCUMENTS

| | | | |
|---|---|---|---|
| 3,445,294 | 5/1969 | Leonard | 429/39 |
| 3,530,005 | 9/1970 | Leonard | 429/39 |
| 3,814,631 | 6/1974 | Warszawski et al. | 429/39 |
| 4,124,478 | 11/1978 | Tsien et al. | 204/279 X |
| 4,139,448 | 2/1979 | Wallace | 204/266 X |
| 4,210,512 | 7/1980 | Lawrance et al. | 204/257 |

FOREIGN PATENT DOCUMENTS

| | | | |
|---|---|---|---|
| 1014529 | 8/1957 | Fed. Rep. of Germany | 204/286 |
| 2821982 | 11/1979 | Fed. Rep. of Germany | 204/253 |

*Primary Examiner*—Delbert E. Gantz
*Assistant Examiner*—D. R. Valentine
*Attorney, Agent, or Firm*—Burns, Doane, Swecker & Mathis

[57] ABSTRACT

An electrode package is disclosed which comprises a substantially flat electrode (32) surrounded by two substantially flat inner frames (1) which are surrounded by a substantially flat outer frame (20) with holes (21, 22) for supply of electrolyte to and holes (23, 24) for discharge of electrolyte from the electrode. Each of the inner frames is provided with a grid (13) that improves the electrolyte flow and serves as a support for a membrane when used in membrane cells, and furthermore with flow-distributing projections and possibly barriers, making it possible to achieve varying flow patterns for the electrolyte with the same basic construction. The outer frame is preferably provided with ridges, going all the way round, for the simple fitting and sealing of a membrane against it. The electrode package will, thus, be particularly suitable for use in membrane cells in electrolyzers of the filter-press type, said use also being described herein. The electrode current conductors (33) are suitably arranged in the form of circular rods on the long side of the electrode, which is preferably rectangular, and taken out through holes in the frames.

15 Claims, 11 Drawing Figures

ELECTRODE PACKAGE AND USE THEREOF

The present invention relates to an electrode package comprising a substantially flat electrode intended for use in an electrochemical cell. The electrode package is particularly usable in a membrane cell in a filter-press type of electrolyser. The invention furthermore relates to a use of the electrode package.

Electro-chemistry has industrially always been dominated by the production of chlorine-alkali and chlorate. These products have been the most economically important and have therefore attracted most interest. A variety of cell types have been developed during the course of time for these applications.

However, the dominating cell types, the mercury cell and diaphragm cell, retained their position for a long time, and the improvements which have occurred have only been marginal. Two great innovations have, however, given new impetus to development during the last decade. These two are the hydraulically stable ion exchange membranes and the dimensionally stable anodes.

As far as cell development is concerned, it has been a question of adapting the devices so that the greatest possible advantage could be taken of the novelties. The electrodes are often formed as permeable electrodes to impart thereto the greatest possible area, and to enable the membrane to be placed as close to the electrode as possible. One has also returned to filter press cells, since these are more suitable together with the two-dimensional membranes. Maintenance, however, has been a problem. There has been a desire to avoid the necessity of closing off a complete row of cells while e.g. a broken membrane or some other deficiency has been attended to. A proposed solution to this is to form each electrode pair as an individually exchangeable pack, e.g. as disclosed in U.S. Pat. No. 4,056,458.

A general characteristic of all these solutions is, however, that they are very strictly adapted to one process, usually a chlorine-alkali production. They are seldom suitable for other electro-chemical processes. This is particularly in evidence when the volumes are small and the products can no longer bear the costs of specially adapted structures. This has been found to be the case in the organic electro-chemical field above all, where many processes which are promising per se have been kept back by the necessity of also constructing suitable electrolysis equipment.

A flexible cell which is versatile in use must meet requirements which are in some respects not the same as those for a chlorine cell. What is common is the requirement of small electrode spacing and the desirability of some kind of construction in packages. The electrodes must be easily exchangeable, however, since different processes require different electrode materials. Furthermore, the cell must be constructed of a material resistant to corrosion in as many conceivable electrolytes as possible. It is also known that many metals disturb the electrode processes and lead to the poisoning of the electrodes. A cell made from an inert plastics material would thus be very desirable. If the components of the cell can be injection moulded, the precision can be achieved which is required for proper sealing and the avoidance of too large potential gradients across the electrode surface, due to varying electrode spacing. It would also be possible to keep the price down, if manufacturing series can be reasonably long. Injection moulding requires, however, that the number of differently shaped parts can be kept low.

All this is enabled by the new electrode package in accordance with the present invention. In turn, this is achieved by the electrode package being given the characterizing features apparent from the appended patent claims.

What is characterizing for the electrode package according to the invention is, thus, that it comprises a substantially flat electrode surrounded and located by two mutually engaging, substantially flat inner frames with inlet and outlet channels for electrolyte, the central opening defined by the inner frames, which admits access of electrolyte to the electrode, being covered by a grid on each inner frame, that both inner frames in turn are surrounded, along their peripheral edges, by a substantially flat outer frame having at least one hole for supplying, and at least one hole for discharging electrolyte, at least one of the respective holes being in communication via a channel with the inlet and outlet channels of the inner frames, the outer frame being locked, at its inner edge, between both inner frames with the aid of locking means preferably arranged solely on the inner frames for directly locking these to each other, that at least one of the inner frames, on the side facing towards the electrode and opposite the inlet channel, is provided with a boss-like projection intended to serve as a striking surface for incoming electrolyte and for distributing it laterally, and at least in its lower portion with a plurality of constriction means for the electrolyte, preferably projections, between which are formed channels in to the electrode, that at least the second of the inner frames in its upper portion is provided with a plurality of said constriction means, preferably projections, and that the grids of the inner frames comprise strips, or ribs, lying in two planes, which form oblique angles with the electrolyte flow supplied to the electrode.

Thus, the electrode is surrounded by and inserted between the inner frames along its circumferential, or peripheral, edge, and it is located preferably by resting in recesses at the inner edges of the inner frames.

As to the grid within each of the inner frames, it is dimensioned so as to cover the central opening defined by each inner frame, and the opening is contiguous to recesses in the inner frame, which recesses form a chamber for incoming electrolyte and a chamber for outgoing electrolyte. Preferably, the electrode as well as the inner frames have substantially rectangular shapes, said chamber for incoming electrolyte and said chamber for outgoing electrolyte being arranged in the bottom and top edges, respectively, of the inner frame.

The term "opposite" in connection with the boss-like projection is to be interpreted in a broad sense. Thus, the boss-like projection is arranged in the chamber for incoming electrolyte so as to prevent the electrolyte from passing directly into the electrode chamber without any lateral distribution thereof.

In accordance with a preferred embodiment of the invention, both inner frames and the outer frame are made from an injection-mouldable polymer and moulded each by itself in two separate moulds. The inner frame and grid, thus, constitute an integral unit and the grid is suitably attached to the inner edge of the central opening of the inner frame.

Thus, the new electrode package structure for the first time enables the manufacture of synthesis cells from injection-moulded frame parts. Thanks to the new construction, the injection moulding technique will be economically feasible as a result of building into only two frame parts surrounding the electrode, a number of technical functions required for a wide range of processes; only two moulds are required.

The present invention, thus, minimizes the number of differently shaped constructional elements crucial for the cell function, which is an economic condition, since the injection moulding tools are expensive. A large number of identical details can, however, be produced in each separate mould at low cost, and not least important is that the detail material can be selected with reference to resistance to process chemicals. For example, materials of the polyvinyl fluoride or polyvinylidene fluoride type can be used (e.g. "Dyflor 2000" or "Kynar"), which materials are almost impossible to machine into structural elements with thin cross sections and severe tolerance requirements. To accomplish a good sealing of the cell, location and sealing of membrane, location of the electrode, small dimensional deviations in electrode spacing, and above all, an electrolyte distribution system and barrier system for controlled and uniform flow distribution, it is absolutely necessary to have high dimensional tolerance requirements for those details in a cell structure which are embraced by these functions. The injection moulding technique is the only manufacturing method which meets these requirements for this type of material.

Although polyvinylidene fluoride has been mentioned above as an especially suitable material, the frames can very well be moulded in other materials, e.g. polypropylene, polystyrene, nylon, etc., i.e. any kind of injection-mouldable plastic material.

By the special electrolyte distribution configuration of the inner frames, which has been made possible by the precision obtainable with injection moulding technique, a well-defined, so-called plug flow through the cell has been obtainable. Thus, in the present case the term electrolyte distribution configuration includes the boss-like projection of the inner frames, which is suitably so high as to engage against the facing inner frame, and the constriction means which preferably are constructed of a plurality of small projections between which there are formed channels in to the electrode. The latter projections should also be high enough to engage against the electrode or the opposing inner frame.

Since the above-mentioned case with two moulds only (for the inner and outer frame, respectively) represents the ideal case, a preferred embodiment of the invention is the case when the two inner frames are identical with each other. This in turn means that the boss-like projections as well as the constriction means are present on both inner frames and are so high as to bear on each other when the electrode package is assembled.

The width of the boss-like projection is adapted to the incoming electrolyte flow, i.e. so that the latter is laterally directed in both directions right up to the outmost channel into the electrode. The electrolyte distribution configuration enables an extremely uniform distribution of electrolyte across the whole electrode, i.e. across the whole width as well as height of the electrode. The plug flow, thus, means that the electrolyte flow over the electrode has a substantially straight front.

The grid of the inner frames, which is preferably a part of the frames themselves, serves several important purposes. Since the grid is comprised of ridges in two planes, turbulence will be generated, since the flow is alternately forced to pass over and under said ridges. The fact that the ridges form oblique angles to the electrolyte flow supplied to the electrode means that gas liberation is facilitated, since gas bubbles do not fasten onto the grid. A specially preferred angle for the ridges relative to the electrolyte flow is between about 30° and 60°, e.g. about 50°. In the case of a membrane cell, the grid furthermore constitutes a support for the membrane that separates cathode and anode electrolytes. The shape of the grid improves the yield of the reaction, by its action on the electrolyte flow, since it gives the condition for an even current load across the whole of the electrode surface, as well as improves the mass transport.

The primary function of the outer frame is to make room for holes for inflow and outflow of electrolyte to and from the cell, respectively. These holes are suitably placed at the bottom and top of the frame, respectively. From said holes at least one distribution channel communicates with the inlet and outlet channels, respectively, of the inner frames.

In synthesis cells of the kind described above, a separation of the electrolyte system by means of a membrane is often required, so as to distribute one electrolyte flow round the anode and another around the cathode. Two separate electrolyte circuits are, thus, involved, which must be fed into and distributed in the cell according to a regular system. In the prior art, this has often required the necessity of a great number of differently shaped constructional elements. In the particularly preferred embodiment of the present invention, which signifies that the outer frame has two holes for supply, and two holes for discharge of the electrolyte and that merely one of the respective holes communicates with the inner frames via a distribution channel, these two functions are executed by one and the same detail. Merely by turning alternate outer frames 180°, the electrolyte can be distributed alternately to the anode and cathode electrolyte departments, respectively. By turning the outer frame in this way, the current supply means of the electrode, which will be described more in detail below, will alternately pass through one or the other side, which to a great extent facilitates interconnection of these for parallel or series connection. A greater number of holes for supply and discharge of the electrolyte are also conceivable in the cases where more than two different electrolytes are to be distributed in the cell, e.g. in electrodialysis.

Another important function that is built into the outer frame is connected with the use of the electrode package in a membrane cell. In this case the outer frame on one side is provided with several, e.g. three, circumferential edges, or ridges, or projections. Hereby, combined clamping and sealing of the membrane is obtained. Thus, the membrane separating the electrolyte chambers is attached to the ridges in a simple way, by simply pressing the membrane against the ridges.

This attachment gives combined ridge and labyrinth sealing, where the ridge seal means an effective utilization of the membrane area, and where the labyrinth seal ensures that the risk of leakage to the outmost groove, after the last ridge, and thus out from the electrolyte department will be extremely small. By the structure proposed, it has thus been possible to minimize the requisite membrane area in relation to the electrode area, which is of great economic importance, since the membrane cost is an expensive item in this connection. The seal can furthermore be provided without using sealing compounds, gaskets or O-rings, which must be regarded as a considerable advance compared with current technique.

The locking means for locking the inner frames to the outer frame suitably comprises at least two male and female parts placed respectively on the inside of either inner frame and integral with the respective frame, since such locking means provide for very simple assembly. Furthermore, the locking means have preferably mutually differing configuration, thus avoiding the frames to be turned wrong in the assembly. Locking is, thus, preferably carried out so that both inner frames are locked directly to each other, the inner frames sinking into grooves on the inner edge of the outer frame and being thus located laterally and vertically. However, the invention is not limited to said locking method, but other alternatives are of course directly to either side of the outer frame with the aid of locking means.

The package principle described above, with one outer and two inner frames about each electrode should be unique, and substantially facilitates handling. The principle furthermore enables handling a whole stack, comprising several electrode packages, as one unit. However, in spite of the package principle, the invention signifies that electrodes and membranes can very easily be removed and exchanged, which must be considered a very essential contribution to the technique in this field.

The use of the outer frame in accordance with the invention means a still further advantage, since it enables leading the current conductors via holes through the edge of the frame. Accordingly, practically all the sealing problems usually encountered in conjunction with current conductors are eliminated.

According to a particularly preferred embodiment of the invention, the current conductors of the electrode are placed on one side edge thereof, the holes in the outer frame and inner frames, respectively, for passage of the current conductors being made in a corresponding way in the side edge of the outer frame and inner frames, respectively. By coupling directly laterally between series-connected electrodes the advantage of a short distance for current transmission is obtained, resulting in small conductor area and good cooling possibilities. The current conductors are furthermore suitably given a circular cross section, which also contributes to their being easier to seal then current conductors previously used, which were usually in the shape of flat tongues arranged on the electrode plate and upstanding from its upper edge. By turning alternate outer frames 180°, there is also obtained the above-mentioned advantage of current conductors alternatingly originating from one or the other side.

The invention also relates to the use of the abovedescribed electrode package in a membrane cell in an electrolyser of the filter-press configuration, where its advantages should be self-evident to a person skilled in the art.

BRIEF DESCRIPTION OF THE DRAWING

The invention will now be further described in connection with the accompanying drawings in which.

DETAILED DESCRIPTION

Figure 1A:
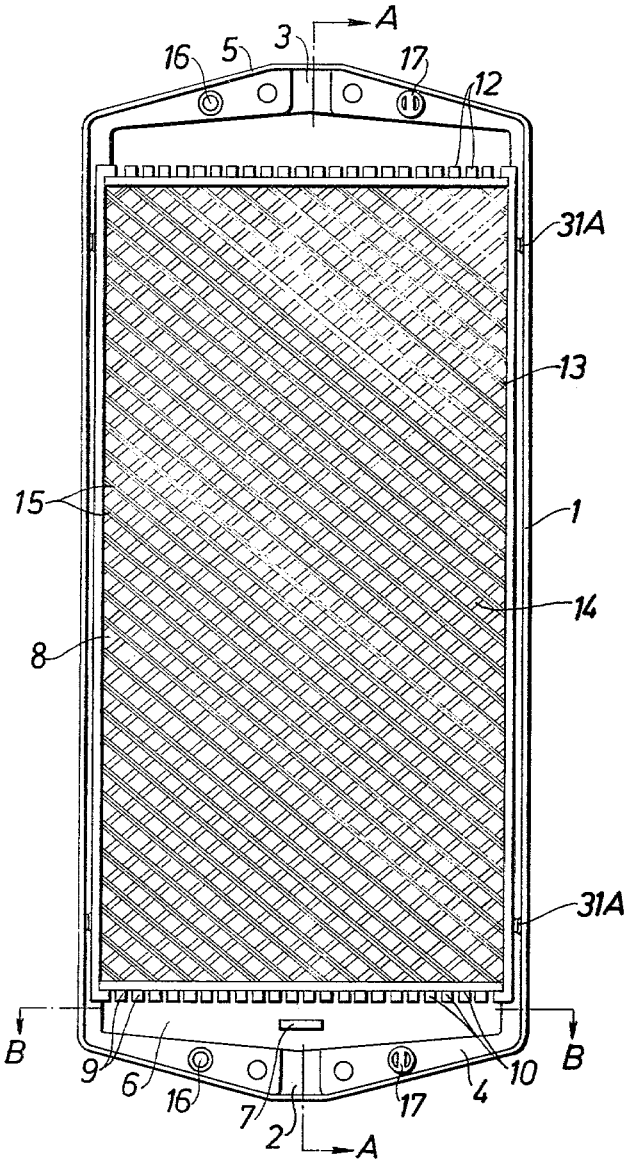
FIG. 1A shows a front view of an inner frame.

FIG. 1A illustrates an inner frame 1 with a rectangular shape and with a bottom inlet 2 and a top outlet 3 for electrolyte. In the illustrated embodiment, the inlet and outlet are grooves in the frame arranged at the middle of its lower edge 4 and upper edge 5, respectively. The lower edge 4 is so wide as to accomodate a distribution chamber 6 in which the electrolyte flow has time to be distributed into a uniform flow before it is fed into the electrolysis chamber in contact with the electrode. In this distribution chamber 6 directly opposite the inlet 2, there is a boss 7, against which the electrolyte flow is intended to strike and be distributed laterally. The chamber 6 is contiguous to the opening 8 defined by the frame 1, this opening being intended to give the electrolyte access to the electrode, and at the edge of the opening 8 the chamber 6 is provided with a plurality of projections 9, serving as constrictions to increase the pressure drop of the electrolyte. In the illustrated embodiment, these projections are evenly distributed, but the invention is of course not restricted to any special distribution or any special appearance of the projections. Channels 10 are, thus formed between these projections, said channels giving rise to an extremely uniform electrolyte distribution with a plug flow. The illustrated embodiment of the inner frame is also provided at its upper edge 5 with a chamber 11, having a plurality of projections 12, which are preferably uniformly distributed and in register with the projections 9 in the lower chamber 6, so that the flow pattern will be even more homogenous.

The opening 8 of the inner frame is covered by a grid 13 which, in the embodiment shown, is integral with the frame and attached to the inner edge of the central, rectangular opening 8 of the inner frame. As will be seen from the drawing, the grid 13 comprises inclined ribs or ridges 14, 15, where one row of mutually parallel ribs 14 lie in one plane and the other row of mutually parallel ribs 15 is above the first row in a plane parallel to the plane formed by the first row of ribs 14. In the illustrated embodiment of the grid, the angle $\alpha$ is about 50° between the ribs 14 and 15, respectively, and the supplied electrolyte flow, or the longitudinal direction of the frame.

Finally, the inner frame 1 is provided with two locking means 16, 17, each at its lower edge 4 and upper edge 5, respectively. These locking means 16 and 17 are mutually dissimilar, to avoid incorrect orientation of the frames when assembled in the outer frame. Furthermore, 31A shows holes for the passage of the current supply means of the electrode.

Figure 1C:
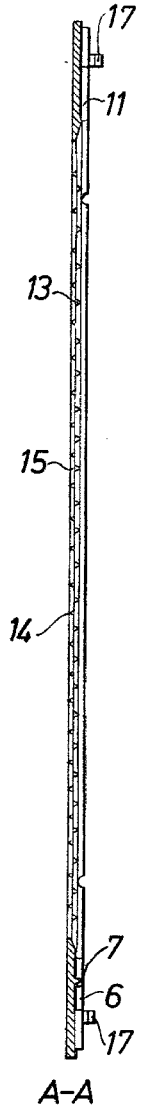
FIG. 1C shows a section seen from one side of said frame.
Figure 1B:
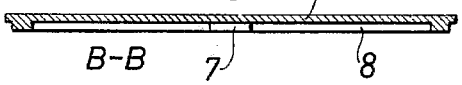
FIG. 1B shows a section seen from above of the same frame.

FIG. 1B shows a section taken along the line B—B in FIG. 1A, and FIG. 1C shows a section along the line A—A in FIG. 1A. The side of the frame 1 facing away from the electrode is thus, in principle, a smooth frame, the opening 8 of which is covered by the grid 13, which is preferably injection-moulded integral with the rest of the frame.

Figure 2A:
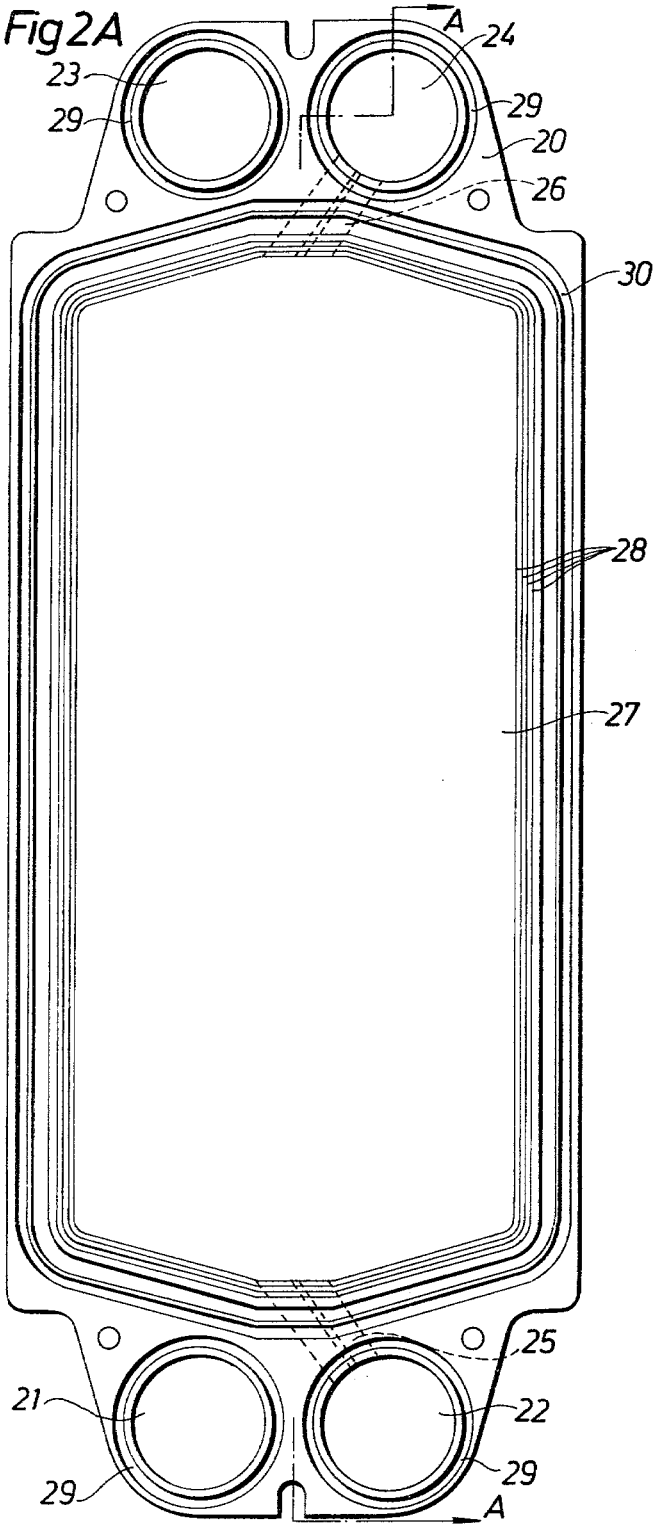
FIG. 2A shows a front view of the outer frame.

FIG. 2A illustrates an outer frame 20 which is at the bottom provided with two holes 21 and 22 for the supply of electrolyte, and in a corresponding way it is provided with two holes 23 and 24 for discharge of electrolyte. From these holes there are distribution channels 25 and 26 (in this case illustrated from the holes 22 and 24, respectively) to the opening 27 defined by the outer frame 20, said channels being intended for communication with the inlets 2 and outlets 3, respectively, of the inner frames. The frame 20 is furthermore provided with projections or ridges 28, going all the way round, in this case three such ridges, functioning as a so-called labyrinth seal and as attachment for a membrane in a membrane cell. Grooves 29 and 30 for O-ring seals are also shown in the figure for the holes 21–24 and the frame 20, respectively.

Figure 2B:
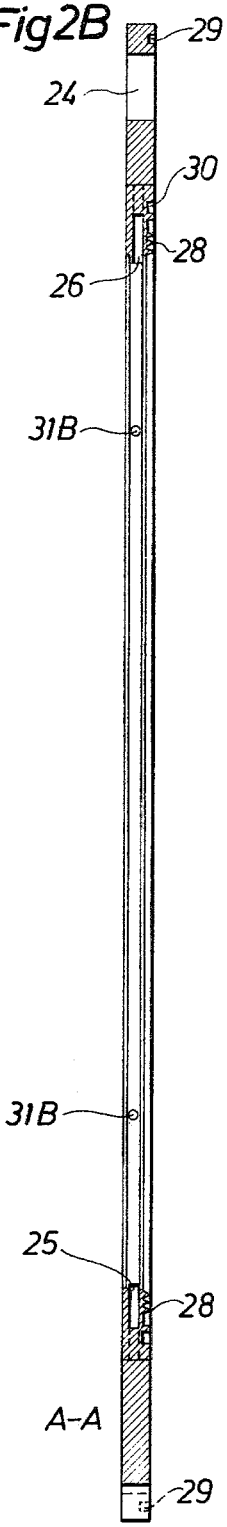
FIG. 2B shows a section of the same frame seen from one side.

FIG. 2B shows a section along the line A—A in FIG. 2A, and apart from the details shown in FIG. 2A there can be seen two holes 31B going through the side edge of the frame 20, and intended for passage of the electrode current conductors.

Figure 2C:
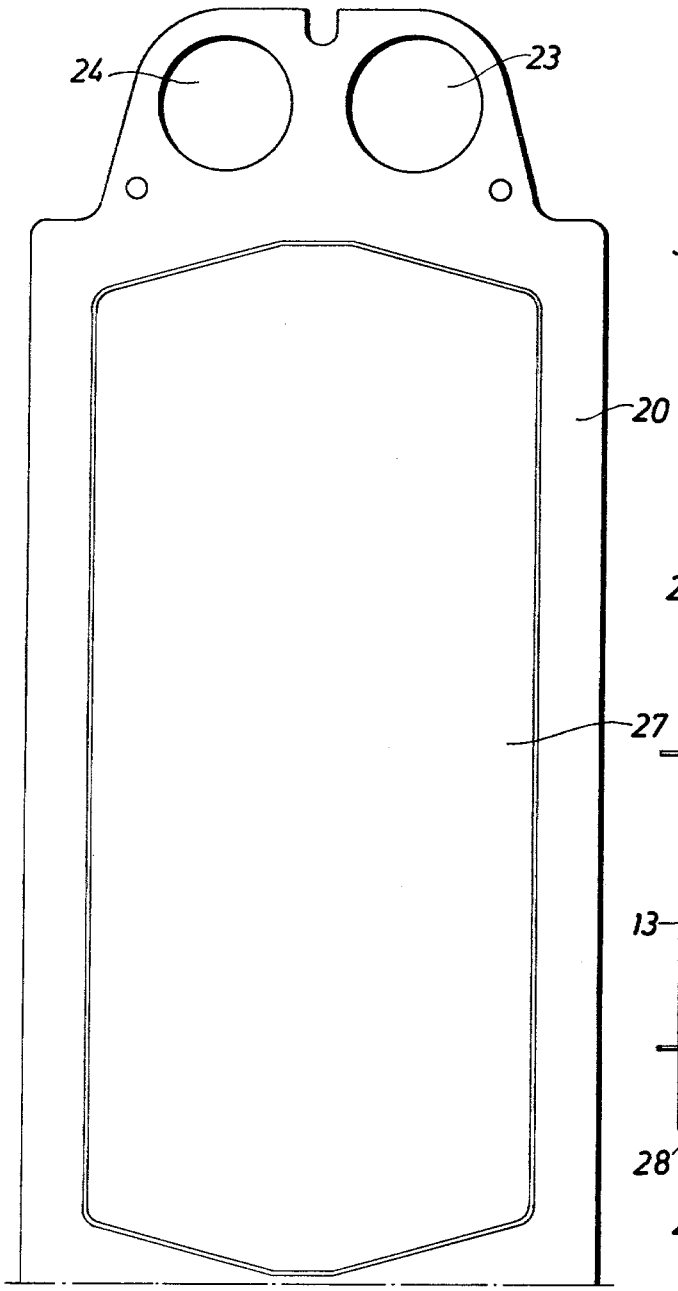
FIG. 2C shows part of the rear side of said frame.

FIG. 2C illustrates a portion of the rear side of the outer frame 20 from FIG. 2A with the holes 23 and 24 and the opening 27. It will be seen from the figure that the rear side is smooth, i.e. not provided with the circumferential ridges 28.

Figure 3:
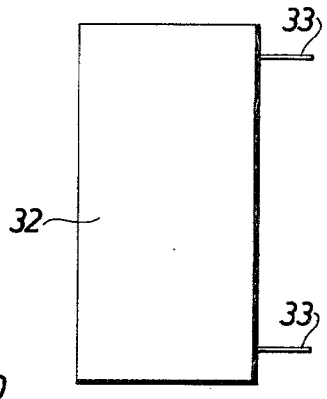
FIG. 3 shows an electrode plate.

FIG. 3 illustrates a homogenous rectangular electrode plate 32, intended for placing between the inner frames 1, it being suitably somewhat larger than the opening 8 in the inner frames so as to be accomodated in a circumferential groove therein. The electrode plate 32 is provided with two current supply conductors 33 in the form of circular rods which are placed at one long side of the rectangular electrode plate, and directly opposite corresponding holes 31 in the outer frame.

Figure 4:
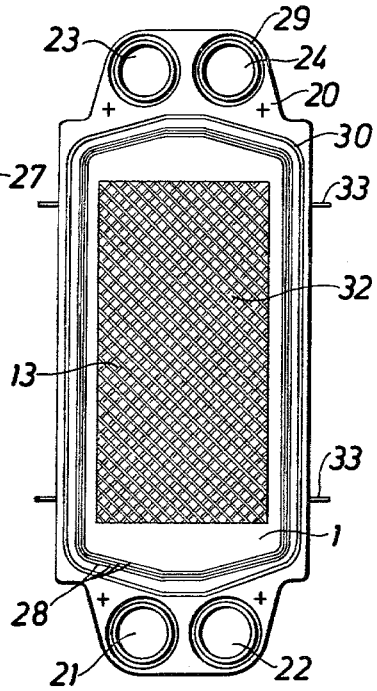
FIG. 4 shows a front view of an electrode package in accordance with the invention.

FIG. 4 shows a front view of the electrode package in the assembled condition, with the electrode plate 32 disposed between the two inner frames 1, which are in turn locked to each other, and with the outer frame 20 locked therebetween. Furthermore, the figure shows the O-ring grooves 29 around the outer frame holes 21–24 which can also be termed electrolyte main channels, and the O-ring groove 30 outside the peripheral ridges 28 on the outer frame. The current supply conductors 33 project through the long side of the outer frame 20.

Figure 5:
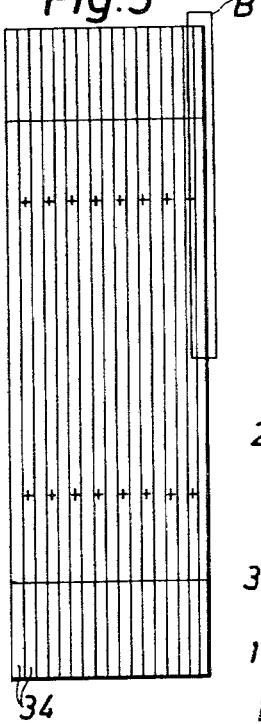
FIG. 5 shows a side view of a whole cell package with several electrode packages arranged side-by-side.
Figure 6:
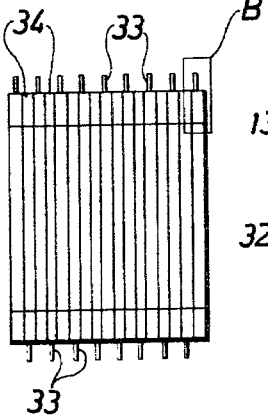
FIG. 6 shows the cell package from FIG. 5 seen from above.

In FIG. 5 there is shown a side view of a whole cell package with a plurality of electrode packages 34 according to the invention arranged side-by-side in a filter press configuration, and in FIG. 6 the same cell pack is shown from above. As will be seen from FIG. 6, the current supply conductors 33 are alternately taken out via one or the other of the long sides of the outer frames, the electrode plates thus being alternately positive and negative, which has been marked in FIG. 5.

Figure 7:
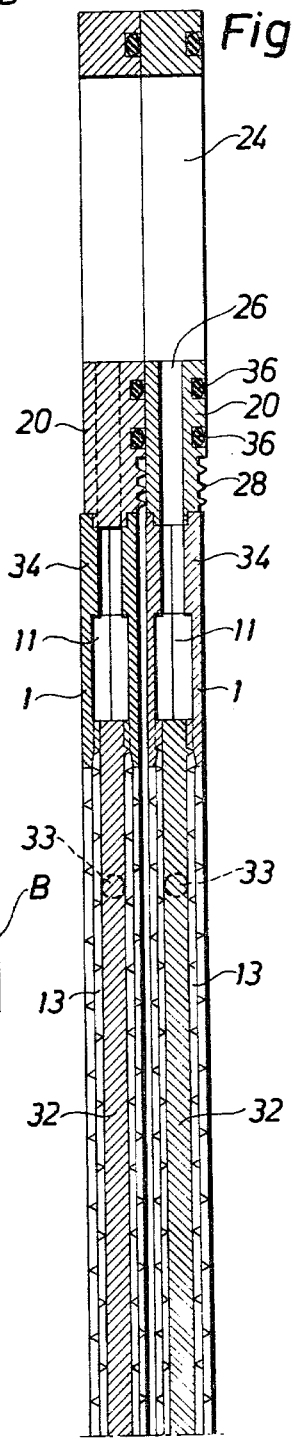
FIG. 7 shows a cross section of detail A from FIG. 5.
Figure 8:
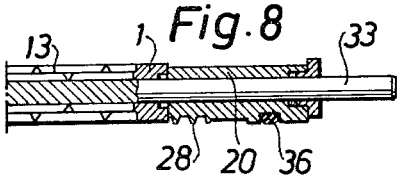
FIG. 8 shows a cross section of detail B from FIG. 6.

FIG. 7 shows in cross section that part of FIG. 5 which has been denoted by A, and FIG. 8 shows in cross section part B from FIG. 6.

There is, thus, illustrated in FIG. 7 two electrode packages 34 with intermediate membranes 35 and O-rings 36. The remaining details shown will not be described closer, but are only illustrated by means of the previously used reference numerals.

FIG. 8 shows the outer frame 20 with ridges 28 and O-ring 36, as well as both inner frames 1 with grid 13 and current supply conductor 33.

The structure illustrated in the above figures can be said to relate to a cell embodiment for a mono-polar, separated (with respect to the electrolyte) cell structure with fixed homogeneous electrodes. However, by some simple changes in the frame portions of the structure, or alternatively its electrodes, the cell structure can be modified within the scope of the invention into, inter alia, a monopolar divided cell with porous through-flow electrodes. The bottom electrolyte intake is sealed on one side, the electrolyte being distributed up only on one side of the porous electrode, to pass therethrough and be led off along the opposing electrode side at the top of the cell. Sealing at the top is effected on the opposite side, compared with the bottom. The grid, which also can be termed a support for the membrane, should naturally be included in this embodiment also, and is assumed to be injection moulded together with the inner frame, as mentioned previously.

The through-flow electrode, which can e.g. be made of porous graphite, porous titanium, a mesh electrode, etc., can be used in such processes where it is particularly important that the specific electrode area with which the electrolyte comes into contact, is large.

Figure 9A:
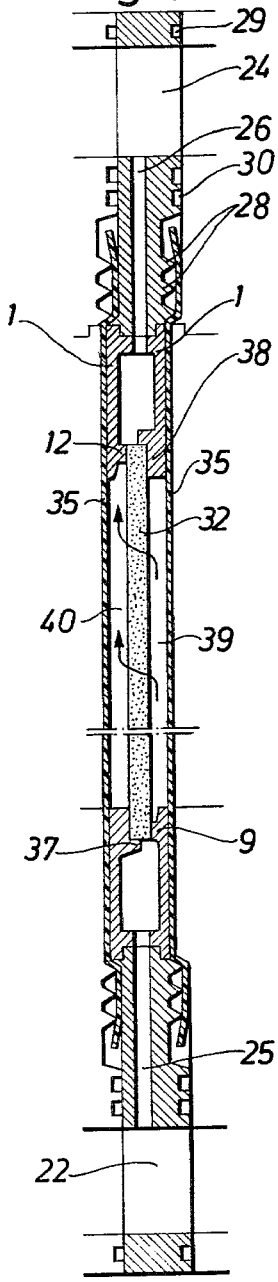
FIG. 9A shows a cross section through a cell with a permeable electrode.

A cell with a permeable electrode is shown in cross section in FIG. 9A, where the arrows illustrate the electrolyte flow in the cell. For the sake of clarity, the inner frame grids have not been drawn in the Figure, but as mentioned above, it is assumed that they are present. For intake and discharge, respectively, of electrolyte, the outer frame is provided with holes 22 and 24, respectively, as previously, which holes are in communication via channels 25 and 26 with the inner frame inlets and outlets, respectively. The outer frame furthermore has O-ring grooves 29 and 30, as well as ridges 28, against which the membrane 35 is clamped. A porous through-flow electrode 32 is arranged between the inner frames 1. Since the left-hand inner frame is sealed downwards at 37 and the right hand inner frame upwards at 38, the electrolyte will pass into the right-hand electrolyte gap 39, pass through the electrode and into the left-hand electrolyte gap 40 to exit from the electrolyte chamber at the left of the electrode 32.

Figure 9B:
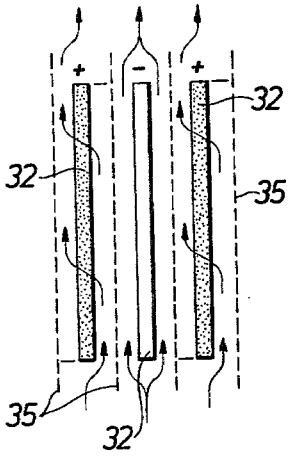
FIGS. 9B and 9C show different flow patterns for cells with permeable electrodes.
Figure 9C:
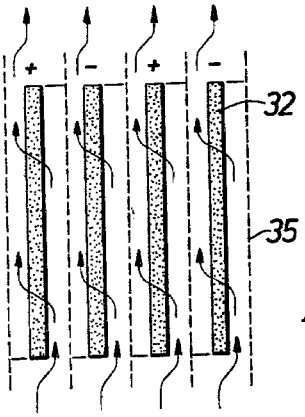

Different flow patterns are conceivable for cells with through-flow electrodes, and are shown schematically in FIGS. 9B and 9C, where the electrodes are denoted by 32 and the membranes by 35. The electrode charge is denoted by + or − and the electrolyte flow is denoted by arrows.

Figure 10A:
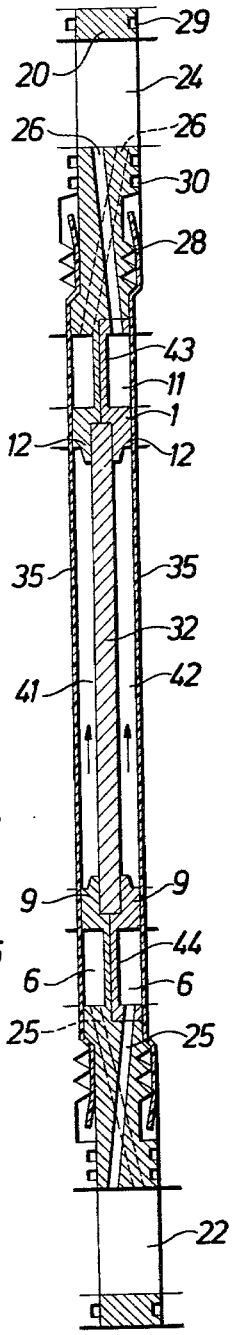
FIG. 10A shows a cross section through a bipolar cell.

Another modified cell structure within the scope of the invention is a bipolar divided cell with fixed homogenous electrodes, where the anolyte (electrolyte for the anode side electrode) is alternatingly led in on one side, and the catholyte on the other side of the bipolar electrode. Such a bipolar cell is illustrated in cross section in FIG. 10A, where the reference numerals are the same as previously for details which have been illustrated previously. The differences which are present in relation to previously illustrated embodiments are that the outer frame distribution channels 25 and 26 have been given the appearance shown in FIG. 10A, i.e. with the left-hand electrolyte chamber 41 in communication, for example, with the holes 21 and 23 in the outer frame and with the right-hand electrolyte chamber 42 in communication with the two other holes 22 and 24 in the outer frame. Furthermore, the inner frames in both upper and lower chambers 11 and 6, respectively, are provided with barrier portions 43 and 44 for partitioning off separate chambers on either side of the electrode when the two inner frames are assembled against each other. The inner frame grid is not shown in this case either, but is assumed to be incorporated.

Figure 10B:
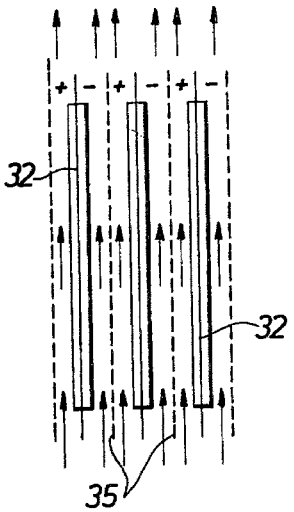
FIG. 10B shows a current flow pattern for a bipolar cell.

An example of the flow pattern for a bipolar cell is illustrated schematically in FIg. 10B, where the reference numerals and denotations have the same meanings as in FIGS. 9 B and 9C. Accordingly, one electrolyte is distributed to all negative sides of the electrode and the other to the positive sides thereof.

Further cell variations are conceivable. Common for these cell structures is that the same basic structure elements (outer and inner frames) are still used. The only modifications which are required in the injection moulding tools are modified coring for the distribution channels or a simple change of the barrier portions.

Figure 11:
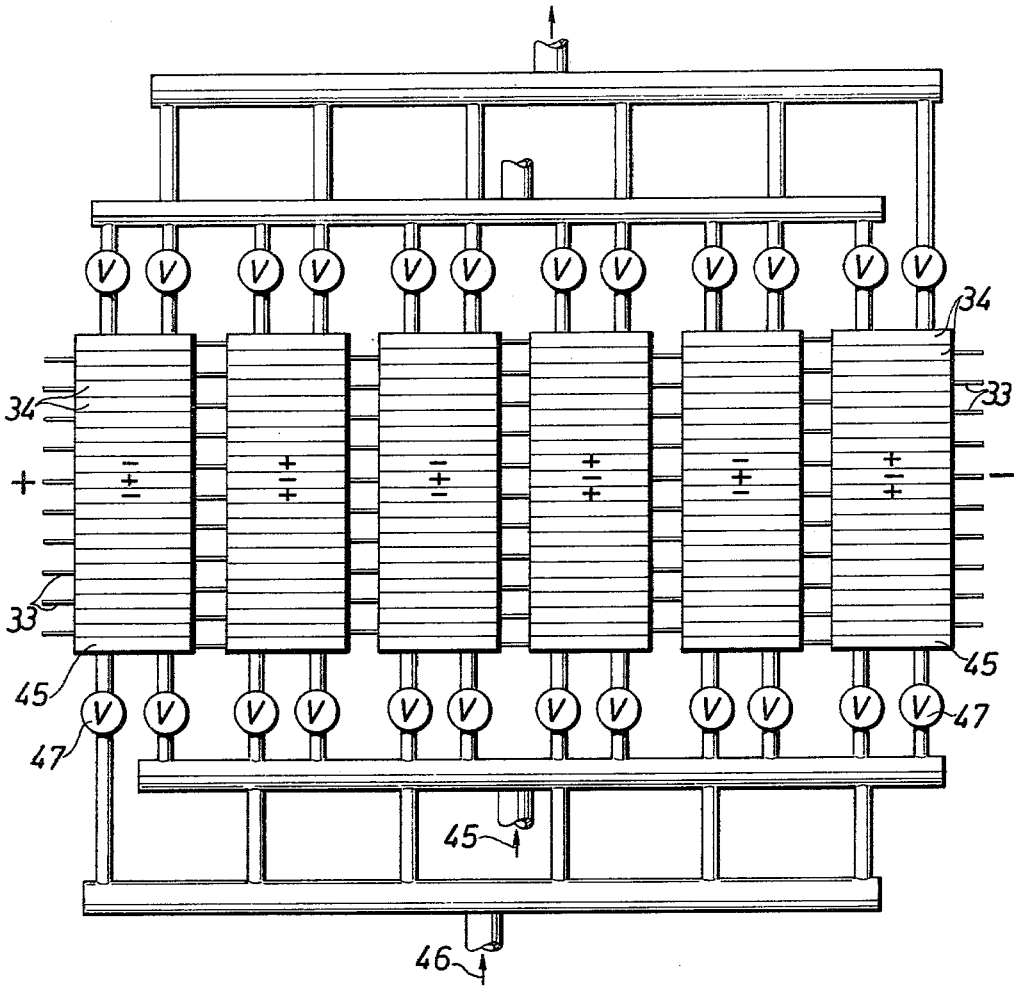
FIG. 11 schematically shows the electrical connections and the division and forming of two separate electrolyte systems for an entire cell unit.

Finally, in FIG. 11 there is schematically illustrated the electrical connections as well as the division and forming of the two separate electrolyte systems for a complete cell unit consisting of six cell packages 45 with twenty cells each. The electrode package according to the invention is denoted by the numeral 34, and there are membranes between each package. Current conductors 33 and the respective charges have been denoted. Electrolyte is supplied at 45 to all negative electrodes, and at 46 to all positive electrodes. The reference numeral 47 relates to valves.

The depicted unit, thus, consists of 10–11 positive electrodes connected in parallel, and the corresponding negative electrodes connected in parallel. Six stacks of these are then connected in series.

The electrode packages in accordance with the invention can be used, apart from in conjunction with the processes mentioned in the introduction, in cells, where e.g. the following compounds are produced:

1. Reduction of oxalic acid to glyoxylic acid.

In such a process the catholyte consists of a saturated aqueous solution of oxalic acid and the anolyte of diluted sulphuric acid. The electrodes are suitably manufactured from lead and the cell is provided with a cation exchange membrane. The glyoxylic acid content should not be allowed to exceed 1 mole/dm$^3$. At a temperature of 14° C. and a current density of 20 A/dm$^2$, a material yield of 98% and a current yield of 75% were obtained.

2. Oxidation of cerium(III) to cerium(IV).

Sulphurous solution of cerium(III)sulphate is oxidized on a lead dioxide anode. The catholyte consists of diluted sulphuric acid, the cathode of steel, while the membrane is of the anion exchange type. With an input concentration of 0.1 mole/dm$^3$ and a current density of 1 A/dm$^2$, a current yield of 83% was obtained. When the oxidization was instead carried out on a cerium nitrate solution (0.4 mole/dm$^3$) with an anode of platinized titanium the current yield rose to 89%.

These processes are solely some examples of the innumerable reactions for which the new cell structure can be utilized.

While the invention has been described above with reference to rectangular shapes of the electrode and frames, at the same time expressions related to the rectangular shape such as side edge, top and bottom edges and chambers, etc., being used, it is of course not limited to said shapes, although they are preferable per se. Thus, the electrode and frames can be given almost any shapes without deviating from the inventive idea. In such cases the terms "side edge" as well as "upper", or "top", and "lower", or "bottom", will be related to the ultimate use of the electrode package in an electrolyser and what can there be considered "sideways" or "upwards" and "downwards".

What is claimed is:

1. An electrode package intended for use in an electro-chemical cell, especially in a membrane cell in an electrolyzer of the filter-press type, wherein a substantially flat electrode (32) is surrounded and located by two mutually engaging substantially flat inner frames (1) with inlet and outlet channels (2 and 3) for electrolyte, the central opening (8), defined by said inner frames, and allowing access of electrolyte to the electrode, being covered by a grid (13) on each inner frame; both inner frames in turn are surrounded by a substantially flat outer frame (20), having at least one hole (21, 22) for supply, and at least one hole (23, 24) for discharge of electrolyte, at least one of each of said holes (22 and 24, respectively) via its own channel (25, 26) being in communication with the respective inlet and outlet channels of the inner frames, the outer frame being locked between the two inner frames by means of locking means (16, 17); at least one inner frame, on the side facing towards the electrode and opposite the inlet channel (2) is provided with a boss-like projection (7) intended to serve as striking surface for incoming electrolyte and for distributing it laterally, and at least in its lower portion (6), with a plurality of constriction means (9) for the electrolyte in to the electrode; at least the other of the inner frames is provided in its upper portion (11) with a plurality of said constriction means (12); and the grids of the inner frames comprise ribs (14, 15) lying in two planes, which form oblique angles to the electrolyte flow fed to the electrode.

2. An electrode package as claimed in claim 1, wherein the outer frame (20) is provided on one side thereof, with a plurality of ridges, or projections, (28) going all the way round and being intended for attaching a membrane (35) by the latter being pressed against said ridges, or projections.

3. An electrode package as claimed in claim 1 or 2, wherein each inner frame (1) and the outer frame (20) are injection moulded from a polymer, each by itself, with all incorporated elements in an integral unit.

4. An electrode package as claimed in claim 1, wherein the outer frame (20) has two holes (21, 22) for supply, and two holes (23, 24) for discharge of electrolyte; and merely one of the respective holes (22 and 24, respectively) communicates with the channel (25 and 26, respectively) in the outer frame, which enables the use of the same outer frame, by turning it 180° around, for distributing the electrolyte to (or from) different electrolyte chambers when using the electrode package in e.g. a membrane cell in an electrolyzer of the filter press type.

5. An electrode package as claimed in claim 1, wherein the current conductors (33) of the electrode (32) are placed in such a way that when the electrode package is used in an electrolyzer, they are intended to project sideways; and the inner frames (1) as well as the outer frame (20) are provided with the corresponding holes (31A and 31B, respectively) for the current supply means.

6. An electrode package as claimed in claim 1, wherein both inner frames (1) are each provided with two chambers, i.e. a chamber (6) for incoming electrolyte and a chamber (11) for outgoing electrolyte.

7. An electrode package as claimed in claim 1, wherein the locking means (16, 17) each comprise at least two male and female parts, respectively, placed on the inside of the respective inner frames, said parts having mutually dissimilar form, whereby incorrect assembly of the frames is avoided; the outer frame (20) is located between the two inner frames (1) by means of recesses at the outer edges of the inner frames.

8. An electrode package as claimed in claim 1, wherein the ribs (14, 15) of the grid form an angle of between about 30° and 60° to the flow of the supplied electrolyte.

9. An electrode package as claimed in claim 1, wherein the electrode (32) is located by resting in recesses at the inner edges of the inner frames (1).

10. An electrode package as claimed in claim 1, wherein the opening (8) defined by each inner frame (1) is contiguous to recesses in the inner frame, which recesses form a chamber (6) for incoming electrolyte and a chamber (11) for outgoing electrolyte.

11. An electrode package as claimed in claim 10, wherein the electrode and inner frames are substantially rectangular; and the chamber (6) for incoming electrolyte and the chamber (11) for outgoing electrolyte are placed in the bottom edge (4) and the top edge (5), respectively, of the inner frame.

12. An electrode package as claimed in claim 10, wherein the two inner frames are each provided with the boss-like projection (7) in said chamber (6) for incoming electrolyte, which projections bear on each other.

13. An electrode package as claimed in claim 1, wherein the outer frame (20) is locked at its inner edge between the two inner frames (1) by means of locking means (16, 17) which are arranged solely on the inner frames for directly locking these to each other.

14. Use of an electrode package as claimed in claim 1, in a membrane cell in an electrolyzer of the filter-press type.

15. Use according to claim 14, wherein alternate outer frames are turned 180° in relation to the remaining outer frames, so that the current conductors are alternately directed to one or the other side of said frames.

* * * * *